US007673774B2

(12) United States Patent
Molloy et al.

(10) Patent No.: US 7,673,774 B2
(45) Date of Patent: Mar. 9, 2010

(54) TRANSITIONS FOR CONTAINERS

(75) Inventors: Adia Nicole Molloy, West Chester, OH (US); Bradley Scott Neufarth, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 582 days.

(21) Appl. No.: 11/273,042

(22) Filed: Nov. 14, 2005

(65) Prior Publication Data

US 2007/0257057 A1 Nov. 8, 2007

Related U.S. Application Data

(60) Provisional application No. 60/628,017, filed on Nov. 15, 2004.

(51) Int. Cl.
*B67D 1/16* (2006.01)

(52) U.S. Cl. ..... 222/109; 222/568

(58) Field of Classification Search ..... 222/109, 222/571, 110, 111, 562, 566–568
See application file for complete search history.

(56) References Cited

U.S. PATENT DOCUMENTS 4,047,643 A * 9/1977 Hazard ..... 222/153.14
4,696,416 A 9/1987 Muckenfuhs et al.
D292,491 S * 10/1987 Ross et al. ..... D9/447
4,706,829 A * 11/1987 Li ..... 215/354
4,830,234 A * 5/1989 Odet ..... 222/465.1
4,836,419 A * 6/1989 Metz et al. ..... 222/110
4,917,268 A * 4/1990 Campbell et al. ..... 222/109
5,108,009 A * 4/1992 Davidson et al. ..... 222/109
5,131,566 A * 7/1992 Bavegems ..... 222/80
5,566,862 A * 10/1996 Haffner et al. ..... 222/111

FOREIGN PATENT DOCUMENTS

CA 2 363 039 A1 5/2003
FR 2 631 935 A 12/1989

OTHER PUBLICATIONS

International Search Report, PCT/US2005/041378, 2 pages.

* cited by examiner

*Primary Examiner*—Frederick C. Nicolas
(74) *Attorney, Agent, or Firm*—David V. Upite; Mark A. Charles; Kim William Zerby

(57) ABSTRACT

A transition for dispensing a composition from a container comprises a collar; a spout comprises an opening, said spout being capable of directing the flow of the composition out of the container; a drip concentrating member having at least one drain hole functionally connecting the collar and the spout; wherein the drip concentrating member is at least partially non-planar.

2 Claims, 1 Drawing Sheet

TRANSITIONS FOR CONTAINERS

CROSS REFERENCE TO RELATED APPLICATION

This application claims the benefit of U.S. Provisional Application No. 60/628,017, filed Nov. 15, 2004.

BACKGROUND OF THE INVENTION

Containers having transitions are well known in the art. Such containers have been used for a multitude of products including chemical packages, food packages, cleaning packages, and the like. The transitions are typically attached to the container for the purpose of directing any materials contained within the container out in a controlled manner. They also facilitate various means of closing a package, such as providing an area to which a lid or cap can be attached. The transitions associated with containers often have additional benefits relating to such areas as self-draining and flow-limiting capabilities. While transitions for use with various containers are well known in the art, they continue to have longstanding problems associated with their use.

A major problem with the transition involves managing any product that may build within the transition. While several drain-back transitions have been proposed as solutions for allowing the product to flow back into the container, such transitions still do not fully address the problem. For instance, excess product that does not drain fully out of the transition can flow out of the transition beneath or around the spout when dispensing a product causing messiness and/or drips. Such excess product creates a messiness condition that is highly undesirable.

A transition whereby excess product is prevented and/or slowed from flowing out around or beneath the spout, while enhancing overall user appeal is desirable. Such a transition would be even more desirable if it can be created in a minimum of process steps. The present invention addresses these problems.

SUMMARY OF THE INVENTION

One embodiment of the present invention includes a transition for dispensing a composition from a container comprising a collar; a spout comprising an opening, said spout being capable of directing the flow of the composition out of the container; a drip concentrating member having at least one drain hole functionally connecting the collar and the spout; wherein the drip concentrating member is at least partially non-planar.

In one embodiment, the transition is made from a plastic comprising polyethylene, polymethylmethacrylate, polypropylene, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof. In another embodiment, the transition comprises polypropylene.

In one embodiment, the spout has a slit substantially along its length. In another embodiment, the slit and the at least one drain hole are in fluid communication. In one embodiment, the transition further comprises an attachment mechanism functionally connected to the collar capable of at least temporarily fixing the collar to the dispensing orifice or the package. In another embodiment, the attachment mechanism is selected from the group consisting of adhesives, glues, threads, mechanical fasteners, clips, interference fittings, latching mechanisms, and combinations thereof. In yet another embodiment, the attachment mechanism is a latching mechanism.

In one embodiment, the present invention includes the transition, the container, and the cap. Another embodiment includes a kit for a laundry product comprising a laundry active, the container, the cap and the transition of the present invention.

A second embodiment of the present invention includes a transition for dispensing a composition from a container comprising a collar; a spout comprising an opening, said spout being capable of directing the flow of the composition out of the container; a drip concentrating member comprising at least one upper portion, at least one lower portion, and at least one drain hole, said drip concentrating member functionally connecting the collar and the spout; wherein the at least one upper portion and the at least one lower portion are functionally connected by at least one retarding portion.

In one embodiment, the transition is made from a plastic comprising polyethylene, polymethylmethacrylate, polypropylene, polycarbonate, diethyleneglycol bisarylcarbonate, polyethylene terephthalate, polyethylene naphthalate, polyvinyl chloride, polyurethane, epoxy resin, polyamide-based resins, low density polyethylene, styrene butadiene copolymers, acrylonitrile, acrylonitrile-butadiene copolymer, cellulose acetate butyrate and mixtures thereof. In another embodiment, the transition comprises polypropylene.

In one embodiment, the spout has a slit substantially along its length. In another embodiment, the slit and the at least one drain hole are in fluid communication. In yet another embodiment, the transition of the present invention further comprises an attachment mechanism functionally connected to the collar capable of at least temporarily fixing the collar to the dispensing orifice or the package. In still another embodiment, the attachment mechanism comprises adhesives, glues, threads, mechanical fasteners, clips, interference fittings, latching mechanisms, and combinations thereof.

In one embodiment, the at least one upper portion and the at least one lower portion are at least partially non-coplanar. In another embodiment, the attachment mechanism is a latching mechanism.

In one embodiment, the present invention includes the transition, the container, and the cap. Another embodiment includes a kit for a laundry product comprising a laundry active, the container, the cap and the transition of the present invention.

DETAILED DESCRIPTION OF THE INVENTION

Figure 1:
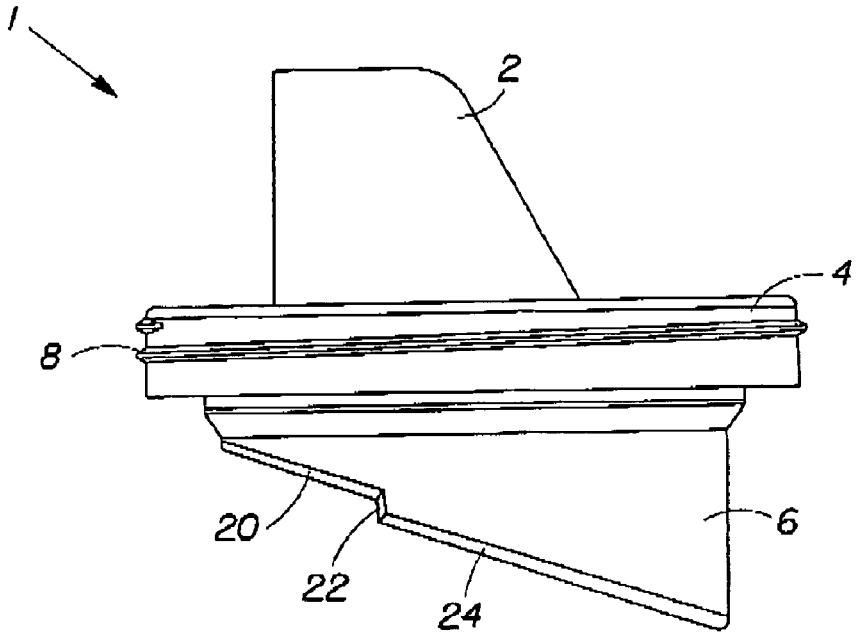
FIG. 1 is a right view of the transition

While the specification concludes with the claims particularly pointing and distinctly claiming the invention, it is believed that the present invention will be better understood from the following description.

The compositions of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages and ratios used herein are by weight of the total composition and all measurements made are at 25° C., unless otherwise designated. An angular degree is a planar unit of angular measure equal in magnitude to 1/360 of a complete revolution.

All measurements used herein are in metric units unless otherwise specified.

It has now surprisingly been discovered that a transition having a collar; a spout comprising an opening, said spout being capable of directing the flow of a composition out of a container; and a drip concentrating member comprising at least one drain hole and at least one retarding portion, said drip concentrating member functionally connecting the collar and the spot addresses the problems of the art. Such a transition can be fabricated inexpensively, while maintaining the characteristics of decreased messiness and improved overall user appeal. Further, the transition is formed such that it is easily scaleable to accommodate different orifice sizes and container sizes.

While not wishing to be bound by theory, it is believed that the retarding portion of the drip concentrating member slows, impedes, and/or otherwise retards the flow of the product collected in the drip concentrating member. Further, it is believed that the retarding slows the product flow such that it is substantially inhibited from flowing out of the drip concentrating member upper. Such slowing substantially prevents product from flowing out of the drip concentrating member during the time necessary to pour product from the container or otherwise utilize the container for dispensing.

As used herein, "container" refers to a hollow or partially hollow vessel capable of maintaining a composition for an indefinite period of time. The container may be free standing, substantially rigid, flexible and malleable, a malleable bag, a malleable sachet, a malleable pouch, and combinations of such forms. A preferred form is a free-standing container having an opening for pouring or dispensing the compositions from the container under the influence of gravity through the transition. The container can preferably be opened and closed repeatedly at the opening; however, containers that can only be opened once without resealing can likewise be utilized.

As used herein, "cap" refers a device capable of sealing, closing, and/or locking a composition within the container. Any type of cap known in the art can be utilized with the container. Such caps include threaded caps, measuring cups adapted for use as caps, diaphragm valves, ball valves, slit valves, press taps, self-draining spouts, traditional spouts, divided spouts, screw caps, pull caps, snap caps, flip caps, vented caps, and combinations thereof. The cap of the present invention, when functionally attached to the container maintains at least about 90%, preferably at least about 95% and most preferably at least about 99% by volume of the composition in the container when the caps are actuated.

As used herein, "composition" or "product" refers to any material contained within the container. Compositions of this invention include fluids and fluidizable solids (solid particles small enough to pour in a fluid-like manner, such particles typically having a diameter of less than about 2.6 cm). These compositions are typically homogenous in nature; however, heterogeneous compositions and multiphase compositions are contemplated.

Transition

In one embodiment, the transition of the present invention comprises a collar; a spout, said spout being capable of directing the flow of a composition out of the container and a drip concentrating member comprising at least one drain hole and at least one retarding portion, said drip concentrating member functionally connecting the collar and the spout.

The spout of the present invention is of such a design that it is capable of guiding a composition or product within the container out of the container. In one embodiment, the spout is functionally connected to the collar. In another embodiment, the spout is connected to the functionally connected to the collar by the drip concentrating member. One of ordinary skill in the art would be readily able to change the shape and size of the spout to properly suit the size, shape and specifications of the container as well as the physical parameters of the composition within the container.

A preferred spout of the present invention is one that has a self-draining or drain-back feature. Such spouts are disclosed in U.S. Pat. Nos. 4,550,862; 4,696,416; and 4,981,239; the entirety of which is incorporated by reference. The self-draining or drain-back features along with the drip concentrator function to direct excess composition back into the container. Further, excess composition that remains in the cap also drains back into the container. This spout embodiment is particularly useful where the cap is used to measure dosages of the composition from the container. The remaining composition within the cap is then able to flow from the cap through the transition and self-draining or drain-back spout into the container.

The drip concentrator of this invention functions to gather any spillage of the composition from the cap and/or the spout and direct the spillage from the transition back into the container. In one embodiment, the drip concentrator of the present invention is interposed between the collar and the spout in such a manner that it has a substantially downward slope. A drip concentrator opening is located at the bottom of the downward slope, which allows the composition to exit the drip concentrator. The downward slope of the present invention is preferably from about 5° to about 70°, more preferably from about 10° to about 50°, even more preferably from about 15° to about 45°. Without wishing to be bound by theory, it is believed that the downward slope of the drip concentrator in combination with gravity guides and/or pulls the composition down the downward slope.

In one embodiment, the drip concentrator comprises a retarding portion. Without wishing to be bound by theory, it is believed that the retarding portion at least partially slows, impedes, and/or otherwise retards compositions in the drip concentrator during pouring of the composition or product from the container.

Any retarding portion capable for use within a drip concentrator is contemplated. Such retarding portions include, but are not limited to, non-planar portions, holes, ridges, bumps or bumping, shoulders, coatings, and combinations thereof. Also contemplated are drip concentrators having retarding portions such that the upper portion and the lower portion of the drip concentrator are non-coplanar. One way of achieving non-coplanar upper portion and lower portion is to have them connected by a retarding portion wherein the retarding portion is substantially transverse to the lower portion and the upper portion. This transverse retarding portion includes, but is not limited to, non-planar portions, holes, ridges, bumps or bumping, shoulders, coatings, and combinations thereof.

The collar of the present invention is of such a design as it attaches and seals to the container and allows for a removably attachable and sealable cap. The collar incorporates the method of attaching to both the container and the cap.

Any method of removably attaching the cap to the collar can be utilized, including but not limited to threading, interference fitting, snap rings, and the like. Preferably, the cap is threadably attached to the collar. Even more preferably, the cap is removably threadably attached to the collar. Attaching the cap to the collar in this manner provides for ease of use, while effectively and removably securing the cap to the collar.

Any method of attaching the container to the collar can be utilized, including but not limited to threading, interference fittings, hooking mechanisms, gluing, riveting, and combinations thereof. In one embodiment, the collar is attached to the container using a combination of hooking mechanisms and gluing. Such a hooking mechanism/gluing attaches to the bottle by incorporating hooks into the collar of the transition. These hooks are typically actuated by pushing the transition down over a container that is capable of receiving hooks. Once in place, these hooks lock into the transition, holding the transition in place on the container.

In a preferred embodiment, the collar has an upside-down "U-shaped" cross-sectional shape, having a distal wall and a proximal wall that are substantially parallel. The collar also has a top wall connected to the distal wall and the proximal wall such that the top wall is substantially perpendicular both the distal wall and the proximal wall. The proximal wall is located with respect to the distal wall such that the circumference of the distal wall is less than that of the proximal wall. The top wall of the present invention is preferably circular in shape, more preferably a circular ring having uniform shape.

The collar, spout, and/or the drip concentrator of this invention can be made of any material known by one of ordinary skill in the art capable of holding compositions in place for an indefinite period of time. While soft or nonrigid materials can be used; materials rigid enough to sit in a substantially upright position are preferred. Such materials include, but are not limited to, metals, woods, plastics, ceramics, and combinations thereof. Plastics include thermoform plastics and thermoset plastics. Such plastics include, but are not limited to high density polyethylene, low density polyethylene, polypropylene, polyvinyl chloride, polyethylene terephthalate, and mixtures thereof. Polypropylene is especially preferred. Likewise the materials may be processed in single or multiple layers. Because a variety of different materials may be used in the construction of the spout and/or the drip concentrator of the present invention the materials selected will be based on the intended end use and characteristics required of such a spout and/or a drip concentrator It is readily known to one of ordinary skill in the art that the material used to form the container can possess wide range of colors and hues. One of ordinary skill would readily know how to color and process the materials used to form the container to achieve any variations in color, as well as degrees of transparency including see-through clear, translucent, and opaque.

In yet another embodiment, the container of the present invention contains instructions for communicating with a user. The instructions can be printed directly on the container or can be placed on the container in the form of a label. One of ordinary skill in the art would readily know how to print instructions on a container made from a particular material. Likewise, one of ordinary skill in the art would readily know how to affix or attach a label to a container. In a preferred embodiment, the label spans the circumference of the container.

EXAMPLE

Figure 2:
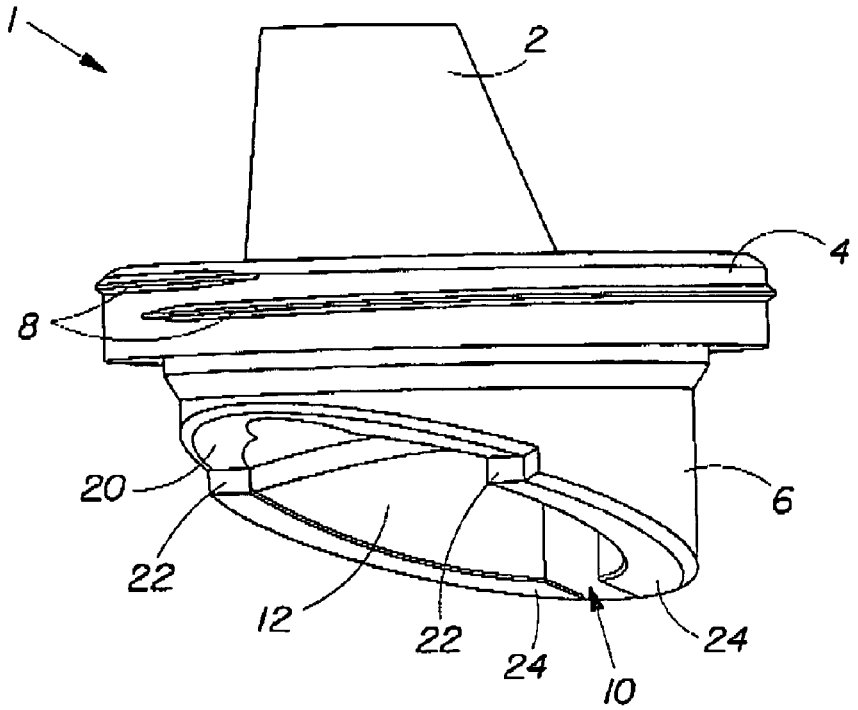
FIG. 2 is a side perspective view of the transition.

One embodiment of a transition is illustrated in FIGS. 1-2. FIGS. 1-2 show a right side view of the transition 1 of the present invention. The spout 2 is functionally connected to the collar 4 by the drip concentrating member 6. The collar 4 also comprises threads 8 for attaching a cap. The upper portion 20 and the lower portion 24 of the drip concentrating member 6 are separated by a retarding portion 22. The drip concentrating member 24 also comprises a drain hole 10 to facilitate the draining of product from the drip concentrating member 24 to the inside of the container. When in combination with a container and a composition or product, the composition or product is dispensed by flowing through the opening 12 out of the spout 2

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An article of manufacture for dispensing a composition from a container comprising:

a collar;

a spout comprising an opening, said spout being capable of directing composition flow out of the container;

a drip concentrating member having at least one drain hole functionally connecting the collar and the spout;

wherein the drip concentrating member comprises an upper portion and a lower portion;

wherein the upper portion and the lower portion are: non-coplanar; and separated by two retarding portions, wherein the drip concentrating member is interposed between the collar and the spout such that it has a substantially downward slope from about 5 degrees to about 70 degrees, wherein the drain hole is located at the bottom of the downward slope.

2. An article of manufacture for dispensing a composition from a container comprising:

a collar;

a spout comprising an opening, said spout being capable of directing composition flow out of the container;

a drip concentrating member having at least one drain hole functionally connecting the collar and the spout;

wherein the drip concentrating member comprises an upper portion and a lower portion;

wherein the upper portion and the lower portion are: non-coplanar; and separated by two retarding portions, wherein the two retarding portions are transverse to the lower portion and the upper portion, wherein the drip concentrating member is interposed between the collar and the spout such that it has a substantially downward slope from about 5 degrees to about 70 degrees, wherein the drain hole is located at the bottom of the downward slope.

* * * * *